US010378774B2

(12) United States Patent
Hu et al.

(10) Patent No.: US 10,378,774 B2
(45) Date of Patent: Aug. 13, 2019

(54) ANNULAR COMBUSTOR WITH SCOOP RING FOR GAS TURBINE ENGINE

(71) Applicant: PRATT & WHITNEY CANADA CORP., Longueuil (CA)

(72) Inventors: Tin Cheung John Hu, Markham (CA); Oleg Morenko, Oakville (CA); Lev Alexander Prociw, Johnston, IA (US); Parham Zabeti, Toronto (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 640 days.

(21) Appl. No.: 14/063,449

(22) Filed: Oct. 25, 2013

(65) Prior Publication Data

US 2015/0113994 A1 Apr. 30, 2015

(51) Int. Cl.

| | |
|---|---|
| ***F23R 3/06*** | (2006.01) |
| ***F23R 3/50*** | (2006.01) |
| ***F23R 3/00*** | (2006.01) |
| ***F23R 3/28*** | (2006.01) |
| *F23R 3/08* | (2006.01) |

(52) U.S. Cl.

CPC ..... *F23R 3/06* (2013.01); *F23R 3/28* (2013.01); *F23R 3/283* (2013.01); *F23R 3/286* (2013.01); *F23R 3/50* (2013.01); *F23R 3/002* (2013.01); *F23R 3/08* (2013.01)

(58) Field of Classification Search

CPC ..... F23R 3/10; F23R 3/04; F23R 3/06; F23R 3/00; F23R 3/28; F23R 3/283; F23R 3/286; F23R 3/50

USPC ..... 60/759

See application file for complete search history.

(56) References Cited

U.S. PATENT DOCUMENTS

| | | | | |
|---|---|---|---|---|
| 2,958,194 A * | 11/1960 | Bayler | F23R 3/06 239/127.3 |
| 3,121,996 A * | 2/1964 | Smith | F23R 3/14 60/744 |
| 3,134,229 A | 5/1964 | Johnson | |
| 3,213,523 A | 10/1965 | Boehler | |
| 3,498,055 A * | 3/1970 | Faitani | F23R 3/14 60/748 |

(Continued)

FOREIGN PATENT DOCUMENTS

| | | |
|---|---|---|
| EP | 1775516 A2 | 4/2007 |
| FR | 2694799 A1 | 2/1994 |
| WO | 2013023147 A1 | 2/2013 |

*Primary Examiner* — Todd E Manahan

*Assistant Examiner* — Eric W Linderman

(74) *Attorney, Agent, or Firm* — Norton Rose Fulbright Canada LLP

(57) ABSTRACT

In a gas turbine combustor having an inner and outer liner defining an annular combustion chamber, at least an annular scoop ring provided on each inner and outer combustor liner. The annular scoop ring includes a solid radial inner base provided with bores defined therein and communicating with the combustion chamber to form air dilution inlets. The scoop ring has a radial outer portion in the form of a C-shaped scoop open to receive high velocity annular air flow. The bores of the inlets communicating with the scoop portion to direct the air flow into the combustion chamber whereby the bores of the inlets form jet nozzles to generate air jet penetration and direction within the combustion chamber.

15 Claims, 7 Drawing Sheets

(56) References Cited

U.S. PATENT DOCUMENTS 3,581,492 A * 6/1971 Norgren ..... F23R 3/06 431/352
3,589,128 A * 6/1971 Sweet ..... F23R 3/54 431/352
3,653,207 A 4/1972 Stenger
3,738,106 A * 6/1973 Stein ..... F23R 3/26 60/39.23
3,845,620 A * 11/1974 Kenworthy ..... F23R 3/08 431/352
3,872,664 A * 3/1975 Lohmann ..... F23R 3/14 431/9
4,058,977 A 11/1977 Markowski
4,081,957 A * 4/1978 Cox, Jr. ..... F23R 3/14 60/737
4,150,539 A 4/1979 Rubins et al.
4,192,139 A 3/1980 Buchheim
4,232,527 A * 11/1980 Reider ..... F23R 3/08 60/754
4,253,301 A 3/1981 Vogt
4,260,367 A 4/1981 Markowski
4,265,615 A * 5/1981 Lohmann ..... F23R 3/346 431/158
4,292,801 A 10/1981 Wilkes et al.
4,292,810 A * 10/1981 Glenn ..... F23R 3/002 60/757
4,301,657 A * 11/1981 Penny ..... F23R 3/045 60/748
4,420,929 A 12/1983 Jorgensen et al.
4,498,288 A 2/1985 Vogt
4,499,735 A 2/1985 Moore
4,590,769 A * 5/1986 Lohmann ..... F23R 3/045 60/752
4,603,548 A 8/1986 Ishibashi et al.
4,628,687 A * 12/1986 Strom ..... F02C 3/32 60/39.23
4,898,001 A 2/1990 Kuroda et al.
4,928,481 A * 5/1990 Joshi ..... F23R 3/346 60/737
4,996,838 A * 3/1991 Melconian ..... F23R 3/58 60/732
5,025,622 A * 6/1991 Melconian ..... F23R 3/425 60/39.464
5,077,969 A * 1/1992 Liang ..... F02K 1/822 60/757
5,109,671 A * 5/1992 Haasis ..... F23R 3/06 60/757
5,127,229 A 7/1992 Ishibashi et al.
5,168,699 A 12/1992 McCarty
5,181,379 A * 1/1993 Wakeman ..... F02K 1/822 60/753
5,231,833 A 8/1993 MacLean
5,233,828 A * 8/1993 Napoli ..... F02K 1/822 60/755
5,235,805 A * 8/1993 Barbier ..... F23R 3/045 60/39.23
5,261,223 A * 11/1993 Foltz ..... F23R 3/002 60/757
5,261,224 A * 11/1993 Shekleton ..... F23R 3/002 60/738
5,279,127 A * 1/1994 Napoli ..... F02K 1/822 60/754
5,285,635 A * 2/1994 Savelli ..... F23R 3/42 60/747
5,303,543 A * 4/1994 Shah ..... F01D 9/023 60/804
5,323,602 A 6/1994 Defever
5,329,773 A * 7/1994 Myers ..... F23R 3/002 60/757
5,357,745 A * 10/1994 Probert ..... F23R 3/10 60/39.37
5,475,979 A 12/1995 Oag et al.
5,599,735 A 2/1997 Moslehi
5,647,739 A * 7/1997 McDonald ..... F23C 6/045 431/10
5,653,109 A 8/1997 Overton
5,727,378 A * 3/1998 Seymour ..... F01D 25/125 60/732
5,746,048 A * 5/1998 Shah ..... F23R 3/12 60/756
5,771,696 A 6/1998 Hansel
5,918,465 A * 7/1999 Schmid ..... B01F 5/061 239/424.5
6,070,410 A 6/2000 Dean
6,145,319 A * 11/2000 Burns ..... F23R 3/002 60/754
6,205,789 B1 * 3/2001 Patterson ..... F23R 3/002 60/754
6,253,538 B1 7/2001 Sampath et al.
6,408,629 B1 * 6/2002 Harris ..... F23R 3/06 60/754
6,427,446 B1 * 8/2002 Kraft ..... F23R 3/06 60/737
6,494,044 B1 * 12/2002 Bland ..... F01D 9/023 60/757
6,508,061 B2 1/2003 Stuttaford
6,543,231 B2 4/2003 Stuttaford et al.
6,557,350 B2 5/2003 Farmer et al.
6,606,861 B2 * 8/2003 Snyder ..... F23R 3/002 60/752
6,931,862 B2 * 8/2005 Harris ..... F23R 3/045 60/732
6,955,053 B1 * 10/2005 Chen ..... F23R 3/06 60/752
7,010,921 B2 * 3/2006 Intile ..... F23R 3/002 60/752
7,448,218 B2 11/2008 Heilos et al.
7,509,809 B2 3/2009 Patel
7,748,221 B2 7/2010 Patel et al.
7,827,801 B2 * 11/2010 Dawson ..... F01D 9/023 60/752
7,942,006 B2 5/2011 Critchley et al.
8,091,367 B2 1/2012 Alkabie
8,104,288 B2 * 1/2012 Woodcock ..... F23R 3/06 60/752
8,113,001 B2 2/2012 Singh
8,151,570 B2 * 4/2012 Jennings ..... F01D 9/023 60/752
8,234,872 B2 * 8/2012 Berry ..... F23R 3/04 239/590.3
8,307,661 B2 11/2012 Harris et al.
9,010,120 B2 * 4/2015 DiCintio ..... F23R 3/06 60/746
9,052,114 B1 * 6/2015 Toqan ..... F23R 3/286
9,062,609 B2 * 6/2015 Mehring ..... F23R 3/06
9,091,446 B1 * 7/2015 Toqan ..... F23R 3/58
9,127,843 B2 9/2015 Prociw
9,228,747 B2 * 1/2016 Prociw ..... F23R 3/286
9,765,968 B2 * 9/2017 Gage ..... F23R 3/06
2003/0177769 A1 * 9/2003 Graves ..... F23R 3/04 60/752
2003/0182942 A1 * 10/2003 Gerendas ..... F23R 3/002 60/752
2003/0213249 A1 11/2003 Pacheco-Tougas
2004/0000146 A1 * 1/2004 Inoue ..... F02C 7/22 60/776
2005/0076650 A1 4/2005 Dedebout
2006/0042263 A1 * 3/2006 Patel ..... F23R 3/06 60/776
2006/0042271 A1 3/2006 Morenko
2006/0196188 A1 9/2006 Burd
2006/0218925 A1 10/2006 Prociw
2006/0272335 A1 * 12/2006 Schumacher ..... F23R 3/12 60/804
2007/0028620 A1 2/2007 McMasters
2007/0130953 A1 6/2007 Burd
2007/0169484 A1 7/2007 Schumacher
2007/0227149 A1 * 10/2007 Biebel ..... F23R 3/06 60/752
2007/0227150 A1 10/2007 Alkabie et al.

(56) References Cited

U.S. PATENT DOCUMENTS

2007/0271926 A1* 11/2007 Alkabie ..... F23R 3/06 60/772
2008/0010992 A1* 1/2008 Patterson ..... F23R 3/06 60/772
2008/0104962 A1 5/2008 Patel
2008/0105237 A1 5/2008 Gandza
2008/0148738 A1* 6/2008 Rudrapatna ..... F23R 3/54 60/804
2009/0071161 A1* 3/2009 Critchley ..... F23R 3/06 60/754
2009/0113893 A1 5/2009 Li
2009/0199563 A1* 8/2009 Chen ..... F02C 7/222 60/740
2010/0000200 A1* 1/2010 Smith ..... F01D 5/186 60/266
2010/0024427 A1* 2/2010 Graves ..... F23R 3/06 60/748
2010/0077763 A1* 4/2010 Alkabie ..... F23R 3/06 60/754
2010/0107645 A1* 5/2010 Kollati ..... F23R 3/002 60/752
2010/0154426 A1* 6/2010 Parker ..... F23R 3/002 60/748
2010/0281881 A1 11/2010 Morenko
2011/0016874 A1* 1/2011 Chandler ..... F23R 3/002 60/772
2011/0185699 A1 8/2011 Danis
2011/0209482 A1* 9/2011 Toqan ..... F01D 9/023 60/804
2011/0239652 A1 10/2011 McMahan
2012/0047908 A1* 3/2012 Poyyapakkam ..... F23R 3/002 60/774
2012/0102959 A1* 5/2012 Starkweather ..... F23R 3/04 60/752
2012/0125004 A1 5/2012 Parsania et al.
2012/0234013 A1 9/2012 Overman
2012/0240588 A1 9/2012 Patel et al.
2012/0247112 A1* 10/2012 Narcus ..... F01D 9/023 60/759
2013/0019604 A1* 1/2013 Cunha ..... F23N 5/16 60/772
2013/0074505 A1* 3/2013 Toronto ..... F23R 3/005 60/746
2013/0174569 A1* 7/2013 Stoia ..... F23R 3/002 60/776
2014/0260260 A1* 9/2014 Morenko ..... F02C 7/222 60/734
2014/0260266 A1* 9/2014 Prociw ..... F23R 3/286 60/737
2014/0260297 A1* 9/2014 Prociw ..... F23R 3/286 60/776
2014/0260298 A1* 9/2014 Prociw ..... F23R 3/06 60/776
2014/0338347 A1* 11/2014 Gage ..... F23R 3/06 60/754
2015/0113994 A1* 4/2015 Hu ..... F23R 3/286 60/759
2015/0159097 A1* 6/2015 Yen ..... C10J 3/845 48/128
2015/0247641 A1* 9/2015 Patel ..... F23R 3/28 60/776
2016/0097535 A1* 4/2016 Prociw ..... F23R 3/286 60/735
2016/0153363 A1* 6/2016 Zysman ..... F02C 9/18 415/144
2017/0363289 A1* 12/2017 Shim ..... F01D 9/023

* cited by examiner

ANNULAR COMBUSTOR WITH SCOOP RING FOR GAS TURBINE ENGINE

CROSS-REFERENCE TO RELATED APPLICATION

The present application claims priority on U.S. patent application Ser. No. 13/795,089, filed on Mar. 12, 2013, and incorporated herein by reference.

TECHNICAL FIELD

The present application relates to gas turbine engines and to a combustor thereof.

BACKGROUND OF THE ART

In combustors of gas turbine engines, an efficient use of primary zone volume in annular combustor is desired. An important component in improving the mixing within the primary zone of the combustor is creating high swirl, while minimizing the amount of components. It has been found however that high velocity outer annulus flow produces low local static pressure drop, and the inability to turn the flow to feed a row of large dilution holes at the inner and outer diameters of an annular combustor may result in poor hole discharge coefficient and low penetration angle of the air jets.

SUMMARY OF THE INVENTION

In one aspect, the present invention provides at least an annular scoop ring on a combustor liner defining a combustion chamber; the ring including a solid radial inner portion provided with bores defined in the ring and communicating with the combustion chamber to form air dilution inlets, and a radial outer portion in the form of a C-shaped scoop open to receive high velocity, annular air flow. The bores communicate with the scoop to direct the air into the combustion chamber wherein the bores form air jet nozzles to generate jet penetration and trajectory within the combustor.

In a more specific embodiment the radial thickness of the inner portion of the scoop ring must meet a minimum ratio of L/D=1 where L is the axial length of the bore and D is the diameter of the bore.

In a still more specific embodiment, the combustor is an annular combustor with inner and outer liners and there is at least an annular scoop ring on each inner and outer liner.

Further details of these and other aspects of the present invention will be apparent from the detailed description and figures included below.

DESCRIPTION OF THE DRAWINGS

Reference is now made to the accompanying figures depicting embodiments of the present invention, in which.

DETAILED DESCRIPTION OF THE PREFERRED EMBODIMENTS

Figure 1:
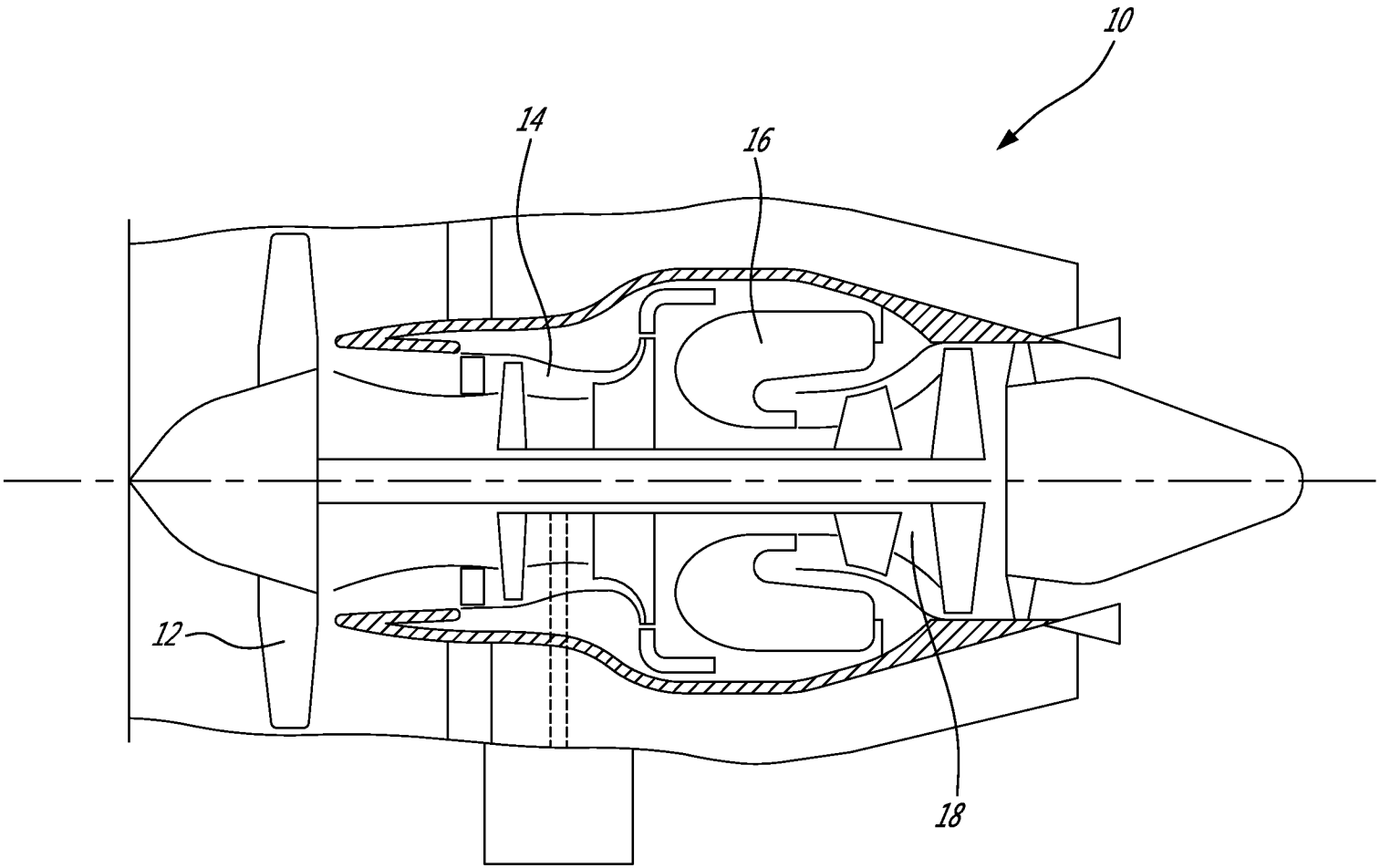
FIG. 1 is a schematic cross-sectional view of a turbofan gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
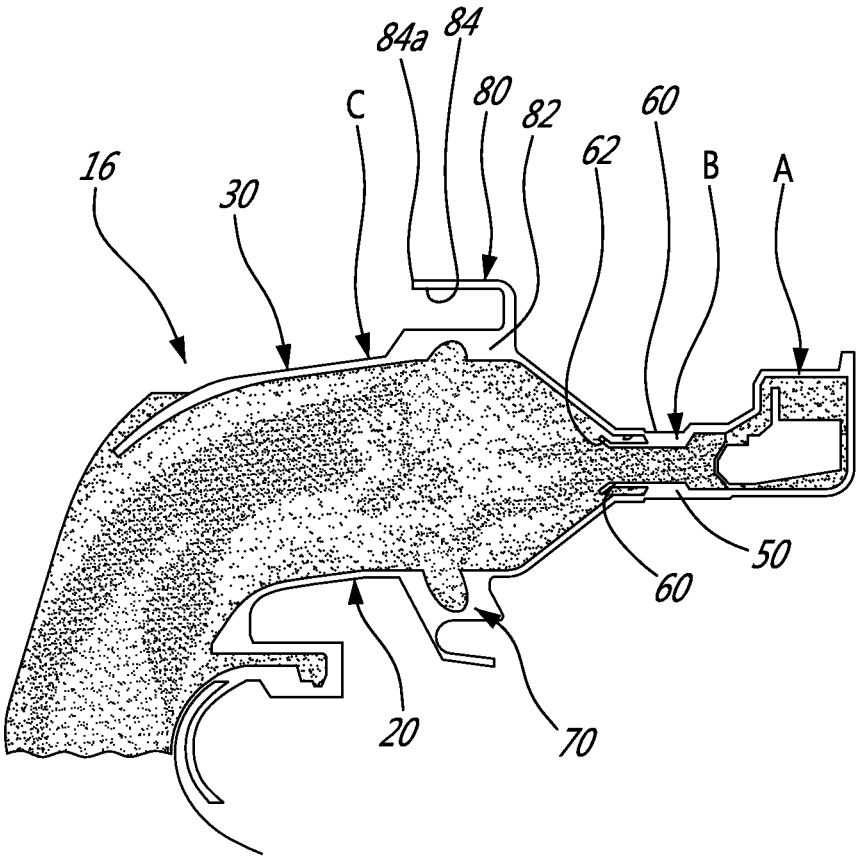
FIG. 2 is a side cross-sectional view of a combustor assembly in accordance with one embodiment.
Figure 3:
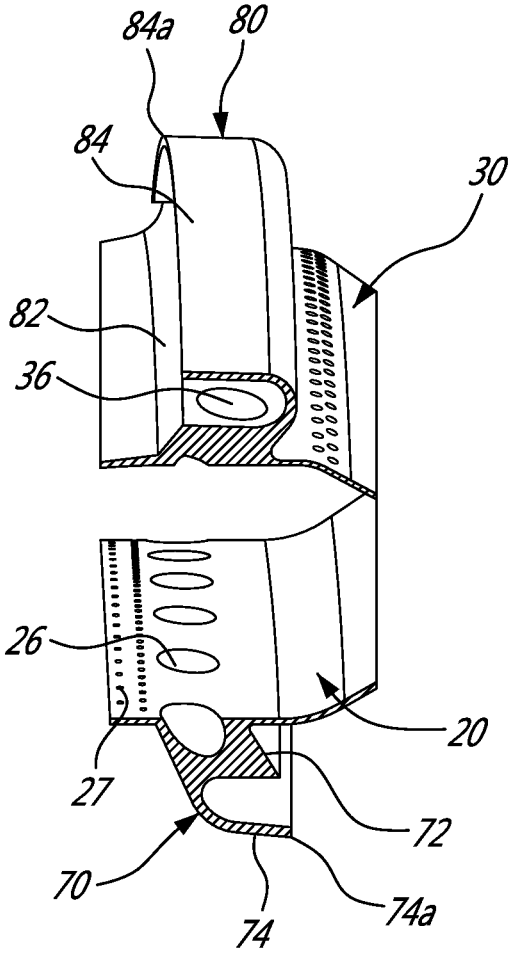
FIG. 3 is a fragmentary perspective view of a detail shown in FIG. 2.

The combustor 16 is illustrated in FIG. 1 as being of the reverse-flow type; however the skilled reader will appreciate that the description herein may be applied to many combustor types, such as straight-flow combustors, radial combustors, lean combustors, and other suitable annular combustor configurations. The combustor 16 has an annual geometry with an inner liner 20 and an outer liner 30 defining therebetween an annular combustor chamber in which fuel and air mix and combustion occurs. As shown in FIG. 2, the upstream end A of the combustor 16 may contain a manifold, fuel and air nozzles. Downstream, is the mixing channel B which includes channel walls 50 and 60 providing a narrow, annular throat favoring complete mixing of the fuel and air. The inner and outer liners 20 and 30 flare out, downstream of the mixing channel B into the dilution zone C, within the combustion zone.

The present description is focused on the dilution zone C. Complementary to this description, U.S. patent application Ser. No. 13/795,089, mentioned above, is incorporated herein by reference.

The liners 20 and 30 are provided with various patterns of cooling inlets represented by the 27 in liner 20, for instance. Annular scoop rings 70 and 80 are provided as integral to the liners 20 and 30 respectively. The scoop rings 70, 80 may also be separately fabricated and welded to the liners. Associated with annular rings 70 and 80 are patterns of air diluting inlets 26, 36, respectively.

Annular ring 80 will now be described in detail. Annular ring 70 is similar to annular ring 80. Annular ring 80 includes a radially inner portion 82 in the form of an annular, solid block, i.e., having a greater thickness than the surrounding liner. A C-Shaped or U-shaped appendage extends radially outwardly from the inner block forming an air scoop 84, open to receive the annular flow air. The dilution air inlets 36 and cooling inlets 37 are in the form of bores extending through the solid block of the inner portion 82 and communicating with the combustion chamber. As described in the above mentioned U.S. patent application Ser. No. 13/795,089, the bores forming the inlets 36 and 37 will be oriented individually at predetermined directions, either at an angle to the radial axis, such as tangential, acute or obtuse depending on the penetration or swirl required of the air jets formed by the bores making up the inlets 36 and 37.

Figure 5:
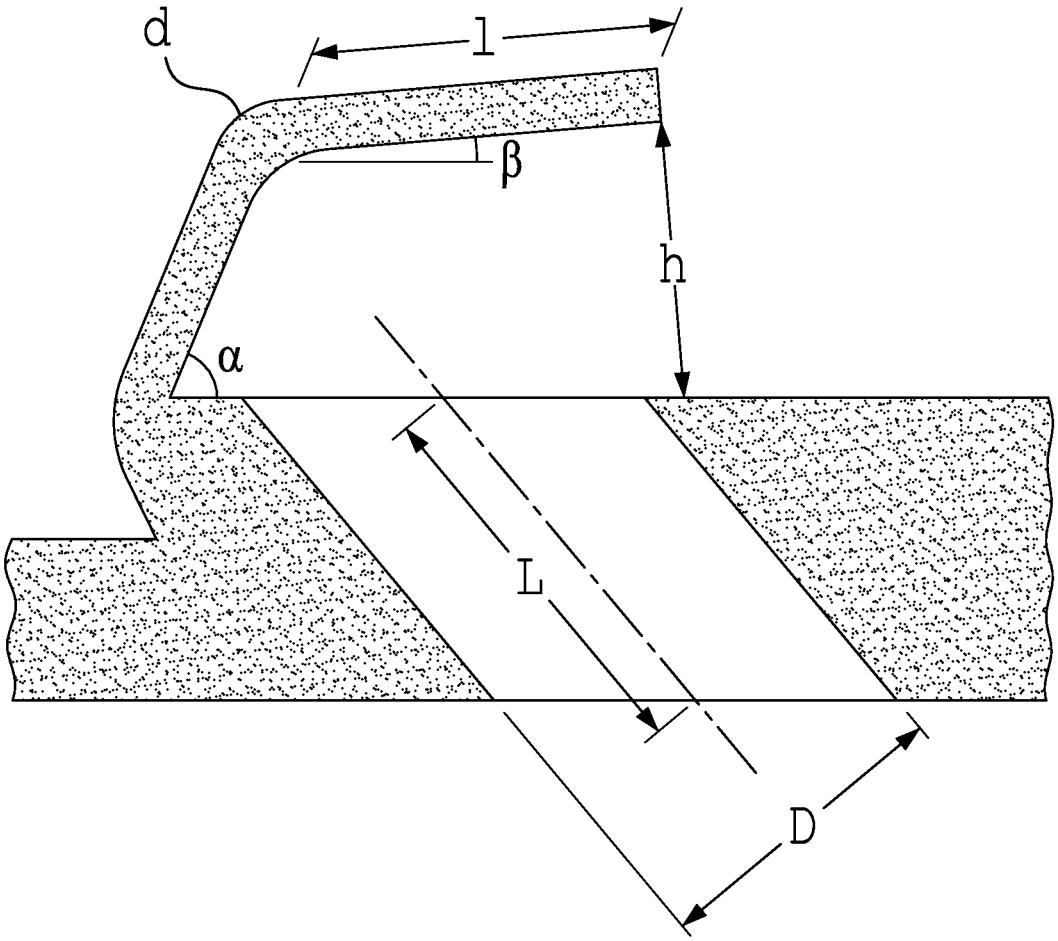
FIG. 5 is a schematic section view showing an axial length to diameter ratio of a bore of a scoop ring of the combustor of FIG. 2.

In order to ensure the formation of air jets by means of the bores making up inlets 36, the radial thickness of the inner block portion 82 must be sufficient to meet a minimum ratio of L/D=1 where L is the axial length of the bore and D is the diameter of the bore (as shown in FIG. 5). The thickness of the inner block portion may be greater, thus increasing the bore length. The block portions may be integrally formed with the liner, or attached thereto (e.g., welding, etc).

The provision of the scoop portion 84 immediately adjacent the inlets 36 captures the dynamic head in the outer air flow to increase the inlet feed static pressure and for a better right angle turn into the inlets 36. The jet flow formed by the bores, defining the inlets 36, result in improved discharge coefficient, higher pressure drop and deeper jet penetration.

Figure 4:
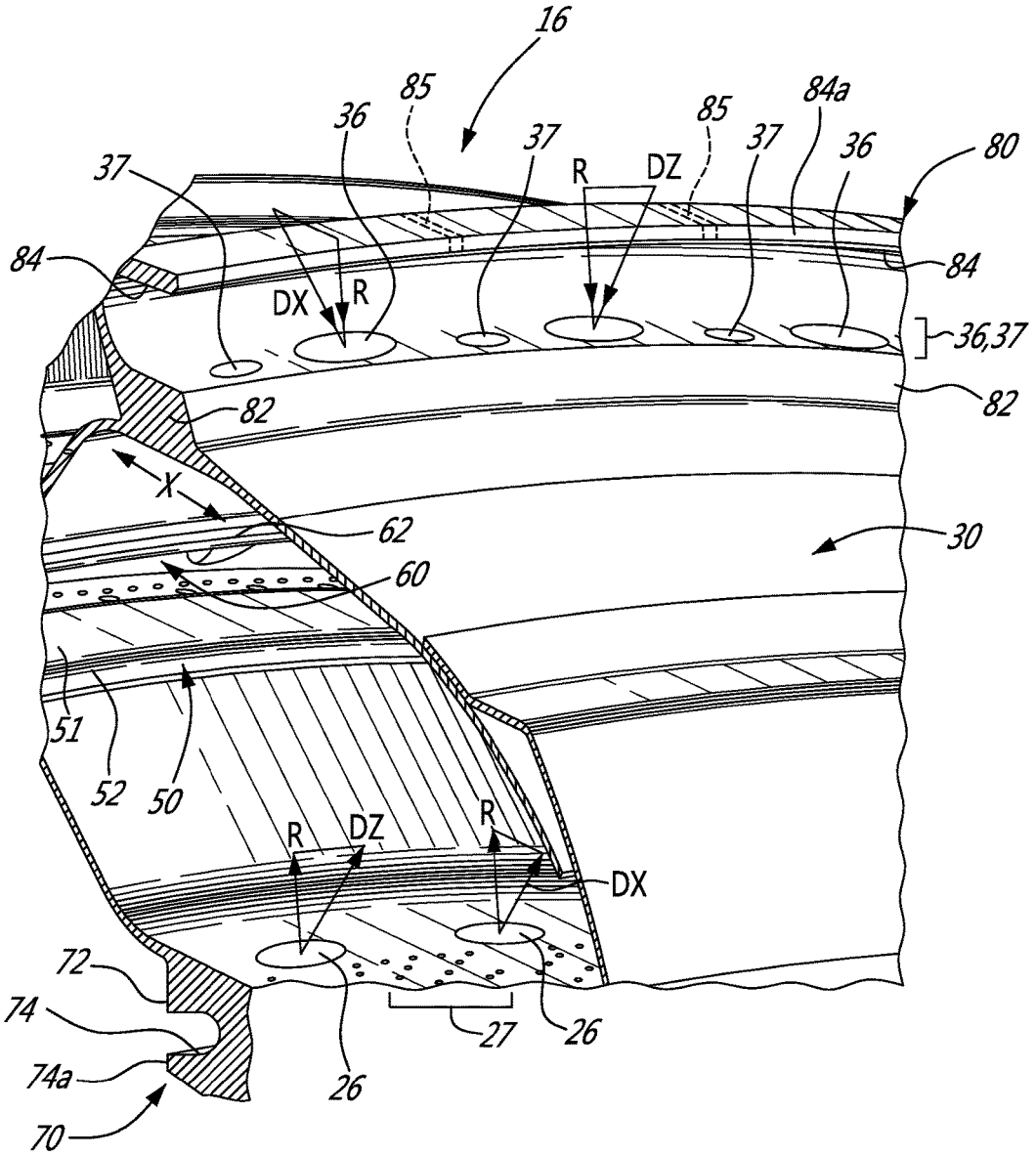
FIG. 4 is a fragmentary perspective view of another detail shown in FIG. 2.

Referring to FIG. 4, dilution air inlets 36 are circumferentially distributed on the respective scoop ring 80, in the dilution zone C of the combustor 16. According to an embodiment, the dilution air inlets 26 and 36 are equidistantly distributed, and opposite one another across the combustion chamber. It is observed that the central axis of one or more of the bores forming the dilution air inlets 26 and 36, generally shown as D, may have an axial component and/or a tangential component, as opposed to being strictly radial. Referring to FIG. 4, the central axis D is oblique relative to a radial axis R of the combustor 16, in a plane in which lies a longitudinal axis X of the combustor 16. Hence, the axial component DX of the central axis D is oriented downstream, i.e., in the same direction as that of the flow of the fuel and air, whereby the central axis D leans towards a direction of flow (for instance generally parallel to the longitudinal axis X). In an embodiment, the central axis D could lean against a direction of the flow.

It should however be understood that the inlets 26 and 36 may have both the axial component DX and the tangential component DZ. The tangential component DZ is oblique relative to radial axis R in an axial plane, i.e., the axial plane being defined as having the longitudinal axis X of the combustor 16 being normal to the axial plane. In FIG. 4, the tangential component DZ is in a counter clockwise direction.

Referring to FIG. 4, the plurality of cooling air inlets 27 may be defined in the inner liner 20 and at least cooling air inlets 37 in the scoop ring 80 relative to the liner 30. The scoop ring 80 has a set of cooling inlets 37 in an alternating sequence with the set of dilution air inlets 36. The cooling inlets 37 have a smaller diameter than that of the dilution air inlets 36. This alternating sequence is a configuration considered to maximize the volume of dilution in a single circumferential ring.

The scoop portion 84, of the scoop ring 80, is open upstream to the direction of annular airflow, in other words, downstream relative to the direction of flow within the combustion chamber, while the scoop 74 of scoop ring 70 is open upstream to the reverse direction of annular airflow adjacent the liner 20, but upstream to the direction of flow of fuel and air within the combustion chamber. Hence, the scoop rings 70 and 80 face opposite directions, although they could face a similar direction as well. The shape of the scoop portion 74, 84 of the scoop ring 70, 80 may be of various open configurations such as U-shaped, C-shaped or other open shapes. The scoop portion 84 includes a forward extending lip 84*a* which may be designed at a selected angle and extension length to optimize the air entrance trajectory and the feed static pressure. For the purposes of this description, the term C-shape is meant to cover the various shapes. Slots 85 may be provided in the scoop portion 84 to relieve any hoop stresses. Like slots may also be provided in the scoop ring 70.

The openings to the diluting air inlets 26, 36 are located on the inner surface of the scoop portion 74, 84, near the bight of the C-shaped portion. The figures show a single row of inlets 26, 27, 36, 37, but multiple rows are considered as well. Sectional dimensions for the inlets 26, 27, 36, 37 may also vary. Referring to FIG. 5, one of the scoop rings 70 and 80 is illustrated as having dimensions d, l and h, and angles $\alpha$ and $\beta$ that can be adjusted in order to obtain the desired effect, for instance to optimize the entrance trajectory and feed static pressure in the case of angle $\beta$.

Figure 6A:
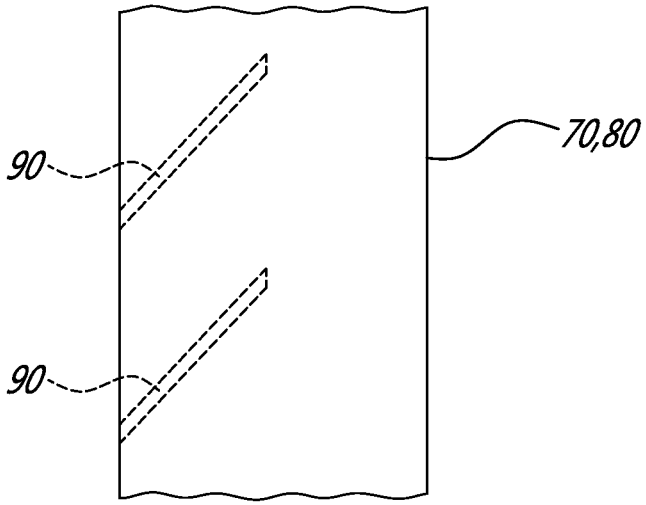
FIGS. 6A and 6B are respectively outer radial and section views of a scoop ring of the combustor, with internal guide vanes.
Figure 6B:
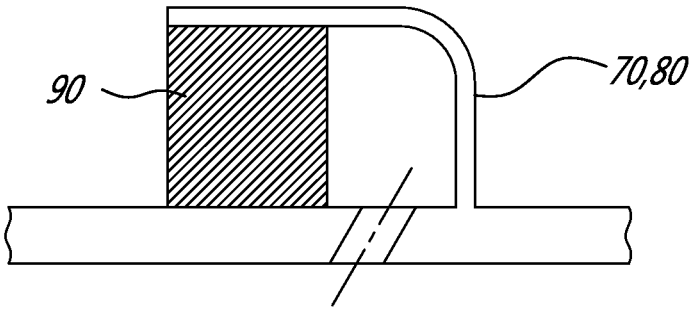
Figure 7A:
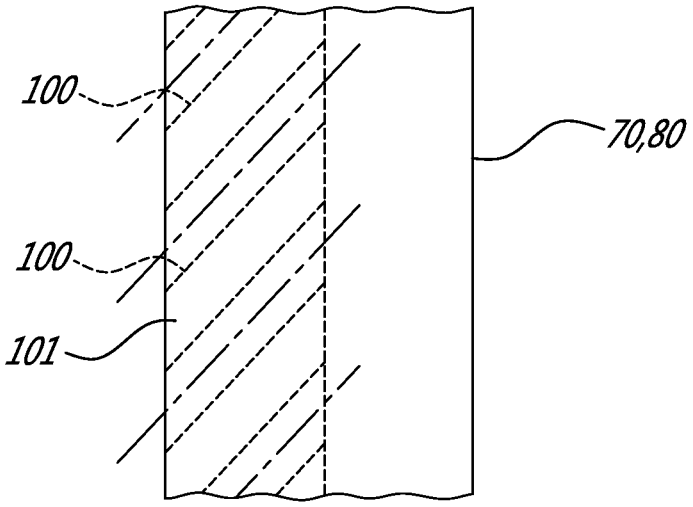
FIGS. 7A and 7B are respectively outer radial and section views of a scoop ring of the combustor, with directional inlet holes.
Figure 7B:
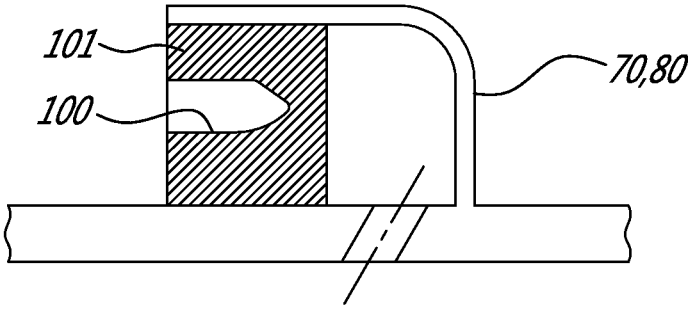

Referring to FIGS. 6A and 6B, internal guide vanes 90 may be provided in the scoop rings 70 and/or 80, to give tangential direction to the incoming flow, hence providing control of the tangential component of the air jet entering the combustor. Alternatively, or additionally, referring to FIGS. 7A and 7B, directional inlet holes 100 may be provided in the scoop rings 70 and/or 80, for the same tangential component purpose. In the case of directional inlet holes 100, they are defined in a radial block 101 added in the scoop rings 70 and/or 80.

The above description is meant to be exemplary only, and one skilled in the art will recognize that changes may be made to the embodiments described without departing from the scope of the invention disclosed. For instance, the annular scoop rings 70, 80 may be present on the outer liner, on the inner liner, or in tandem, so as to obtain the desired mass flow rate and flow feature. Other modifications which fall within the scope of the present invention will be apparent to those skilled in the art, in light of a review of this disclosure, and such modifications are intended to fall within the appended claims.

What is claimed is:

1. A gas turbine combustor comprising an annular liner defining a portion of a combustion chamber; at least an annular scoop ring on the annular liner, the annular scoop ring surrounding the annular liner; the annular scoop ring including a solid radial inner portion provided with bores defined therein and communicating with the combustion chamber to form air dilution inlets; the annular scoop ring having a radial outer portion to define a C-shaped scoop open to receive annular air flow; the bores of the air dilution inlets communicating with the C-shaped scoop to direct an air flow into the combustion chamber; the bores of a plurality of the air dilution inlets being oriented by a central axis of the respective bores having a tangential component relative to the central axis of the combustor chamber, the tangential component being defined by an orientation of the central axis of the respective bores being oblique relative to a radial axis in an axial plane to which the central axis of the annular combustor chamber is normal.

2. The combustor as defined in claim 1 wherein the solid radial inner portion has a radial thickness greater than that of a surrounding surface of the annular liner to project from a surrounding surface of the annular liner, the bores being formed directly into the solid radial inner portion, the radial thickness of the solid radial inner portion of the annular scoop ring having a ratio of at least L/D=1 where L is the axial length of the bore and D is the diameter of the bore.

3. The combustor as defined in claim 1 wherein the combustor is an annular combustor and wherein said annular liner is defined by an inner liner and an outer liner; the annular scoop ring comprising an inner annular scoop ring provided on the inner liner and an outer annular scoop ring on the outer liner with the C-shaped scoop being on the inner annular scoop ring and on the outer annular scoop ring, the C-shaped scoops being open to receive the annular air flow for directing the air into the combustion chamber.

4. The combustor as defined in claim 3 wherein the radial thickness of the inner portion of the scoop ring has a ratio of at least L/D=1 where L is the axial length of the bore and D is the diameter of the bore.

5. The combustor as defined in claim 3 wherein cooling air inlets are provided in an alternating sequence with the air dilution inlets on the inner portion of the outer annular scoop ring.

6. The combustor as defined in claim 4 wherein cooling air inlets are provided in patterns at least in the inner liner.

7. The combustor as defined in claim 6 wherein the air dilution inlets and the cooling air inlets are provided at least in a dilution zone of the combustion chamber.

8. The combustor as defined in claim 1, wherein the central axis of the respective bores of the air dilution inlets have the tangential component relative to the central axis of the annular combustor chamber, the tangential components being in a same tangential direction.

9. A gas turbine engine comprising:

a combustor comprising:

an annular liner defining a portion of a combustion chamber;

at least an annular scoop ring on the annular liner, the annular scoop ring surrounding the annular liner, the annular scoop ring including a solid radial inner portion provided with bores defined therein and communicating with the combustion chamber to form air dilution inlets, the annular scoop ring having a radial outer portion to define a C-shaped scoop open to receive annular air flow, the bores of the air dilution inlets communicating with the C-shaped scoop to direct an air flow into the combustion chamber, the bores of the air dilution inlets being oriented to generate air jet penetration and direction within the combustion chamber, the solid radial inner portion having a radial thickness greater than that of a surrounding surface of the annular liner to project from the surrounding surface of the annular liner, the bores being formed directly into the solid radial inner portion, the radial thickness of the solid radial inner portion of the scoop ring having a ratio of at least L/D=1 where L is the axial length of the bore and D is the diameter of the bore.

10. The gas turbine engine as defined in claim 9 wherein the combustor is an annular combustor and wherein said annular liner is defined by an inner liner and an outer liner; the annular scoop ring comprising an inner annular scoop ring provided on the inner liner and an outer annular scoop ring on the outer liner with the C-shaped scoop being on the inner annular scoop ring and on the outer annular scoop ring, the C-shaped scoops being open to receive the annular air flow for directing the air into the combustion chamber.

11. The gas turbine engine as defined in claim 10 wherein the radial thickness of the inner portions of both of the inner annular and outer annular scoop rings has said ratio of at least L/D=1 where L is the axial length of the bore and D is the diameter of the bore.

12. The gas turbine engine as defined in claim 10 wherein cooling air inlets are provided in an alternating sequence with the air dilution inlets on the inner portion of the outer annular scoop ring.

13. The gas turbine engine as defined in claim 11 wherein cooling air inlets are provided in patterns at least in the inner liner.

14. The gas turbine engine as defined in claim 13 wherein the air dilution inlets and the cooling air inlets are provided at least in a dilution zone of the combustion chamber.

15. The gas turbine engine as defined in claim 9 wherein a central axis of at least one of the bores of the inlet has a tangential component relative to a central axis of the combustor chamber.

* * * * *